US007093739B2

(12) United States Patent
Byun

(10) Patent No.: US 7,093,739 B2
(45) Date of Patent: Aug. 22, 2006

(54) COSMETICS CASE FOR LIQUID COSMETICS

(76) Inventor: Young-Kwang Byun, 928-1005, Mok-Dong APT, 312 Shinjeong-Dong, Yangcheon-Ku, Seoul 158-769 (KR)

( * ) Notice: Subject to any disclaimer, the term of this patent is extended or adjusted under 35 U.S.C. 154(b) by 0 days.

(21) Appl. No.: 10/671,507

(22) Filed: Sep. 29, 2003

(65) Prior Publication Data

US 2004/0256416 A1 Dec. 23, 2004

(30) Foreign Application Priority Data

Jun. 20, 2003 (KR) ..... 10-2003-0040049

(51) Int. Cl.
*B67D 5/42* (2006.01)

(52) U.S. Cl. ..... 222/390; 401/172; 401/175; 132/290

(58) Field of Classification Search ..... 401/172, 401/174, 175; 222/390, 325–327; 132/290
See application file for complete search history.

(56) References Cited

U.S. PATENT DOCUMENTS 1,591,678 A * 7/1926 Garris ..... 222/320
1,943,893 A * 1/1934 Johnson ..... 401/175
1,968,686 A * 7/1934 Janer ..... 222/390
2,699,889 A * 1/1955 Johnson ..... 222/390
3,100,315 A * 8/1963 Laxalt ..... 401/175
3,802,023 A * 4/1974 Spatz ..... 15/192
3,807,881 A * 4/1974 Seidler ..... 401/175
4,655,627 A * 4/1987 Bradley ..... 401/171
4,957,125 A * 9/1990 Yaneza ..... 132/309
5,851,079 A * 12/1998 Horstman et al. ..... 401/174

* cited by examiner

*Primary Examiner*—Frederick Nicolas
(74) *Attorney, Agent, or Firm*—Birch, Stewart, Kolasch & Birch, LLP

(57) ABSTRACT

The present invention relates to a cosmetics case for storing cosmetics such as liquid lipstick and/or foundation and forced discharging the cosmetics as it needs, more particularly, a cosmetics case comprising an upper movable part and a case body, the upper movable part coupled to a cap at top portion thereof while the case body mounted with a plug at bottom portion of the case body, wherein the case has a piston screw-coupled to a screw rod inside the case body and a spring and a reversing ball mounted inside an inner hole formed on top end of the screw rod so that, depending on the case body rotating in normal/reverse directions, the piston goes up and comes down and presses on the reversing ball to make the inner hole to be opened/closed, thereby free controlling discharge and isolation of liquid cosmetics.

2 Claims, 3 Drawing Sheets

COSMETICS CASE FOR LIQUID COSMETICS

BACKGROUND OF THE INVENTION

1. Field of the Invention

The present invention relates to a cosmetics case for storing cosmetics such as liquid lipstick and/or foundation and forced discharging the cosmetics as it needs, more particularly, a cosmetics case comprising a cylindrical case body which can rotate in normal/reverse directions, and a piston screw-coupled to a screw rod and capable of moving up/down depending on the rotational directions of the case body, a reversing ball pressed by movement of the piston to open/close an inner hole formed on top end of the screw rod, whereby liquid cosmetics in the case can freely discharge and/or be interrupted.

2. Description of the Related Art

Conventional cosmetics are generally divided into solid state products and liquid state products mixed with any solution. In recent years, a lot of cosmetics such as lipstick or foundation have been manufactured in liquid state for convenience of consumers. It has been proposed various structures of cosmetics cases including, for example, a typical pencil type case in which the cosmetics is filled and, by rotating any one part of the case, is discharged into an upper cosmetic brush part of the case for make-up use.

An example of such conventional cosmetics cases which is shown in FIG. 6 and FIG. 7 will be described in more detail below.

The cosmetics case generally comprises a case body 1 to receive liquid cosmetics, a cosmetic brush 2 for make-up use wetted by the liquid cosmetics discharged and a cap 3 to protect the cosmetic brush 2.

Within the case body 1, there are a rod 4 having a piston 3 to push out the liquid cosmetics toward the brush 2; a movable body 5 consisted of a nut member 5*a* screw-coupled to the rod 4 and fixed to wall of the case body 1 to assist movement (going up) of the rod 4 and a single-directional rotating guide member 5*b* turning on the nut member 5*a* in only one direction; and a rod moving cap 6 to rotate said rod 4.

However, the cosmetics case with such structure mentioned above has originally the piston 3 fitted to hook-coupling part 4*a* formed at front end of the rod 4 and connected to the same, which causes excessive movement and easy release of the piston 3 out of the rod 4 even by a little impact. Furthermore, since the spring 7 inserted to rear end of the rod and for applying repulsion force to the single-directional rotating guide member 5*b* is directly supported by the rod moving cap 6 at one end of the spring, the cosmetics case has drawbacks to cause interference between one end of the spring 7 and the rod moving cap 6 when turning the rod moving cap 6 round thus prohibiting smooth rotation of the cap 6, and to generate noise during the rotation.

In addition, because the case rotates in only one direction by the movable body 5 comprising such single-directional rotating guide member 5*b* but cannot rotate in the opposite direction, the case has a difficulty in prohibiting leak of the liquid cosmetics when applying a small impact/pressure to the case or positioning the case bottom up.

SUMMARY OF THE INVENTION

It is, therefore, an object of the present invention is to solve the problems mentioned above, in particular, to provide a cosmetics case for liquid cosmetics comprising a case body which can rotate in normal/reverse directions, a piston screw-coupled to a screw rod, a spring and a reversing ball within an inner hole formed on top end of said screw rod; the piston capable of going up/coming down depending on the rotational directions of the case body and pressing the reversing ball to open/close the inner hole, so that the case can freely control discharge and/or interruption of the liquid cosmetics in the case.

BRIEF DESCRIPTION OF THE DRAWINGS

The above object, features and advantages of the present invention will become more apparent to those skilled in the related art from the following detailed description for preferred embodiments taken in conjunction with the accompanying drawing, in which.

DETAILED DESCRIPTION OF THE PREFERRED EMBODIMENT

Figure 1:
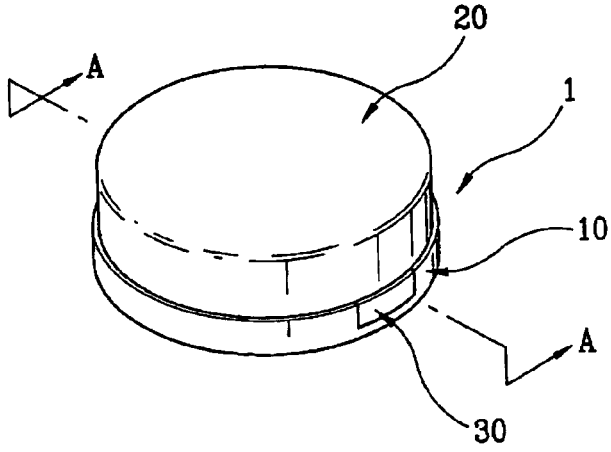
FIG. 1 is a perspective view of a preferred embodiment according to the present invention.

The present invention will be described in more detail be reference to the following embodiments which are presented for purpose of illustration and should not be construed to limit the scope of the invention thereto.

The cosmetics case according to the present invention for achieving such object described above, is characterized in that a piston 49 installed inside the case body 10 rises along a screw rod 40 by revolution of the case body, applies pressure into the case body 10 then allows a reversing ball 43 placed within an inner hole 41 formed on top portion of the screw rod 40 to open the inner hole 41. As a result, liquid cosmetics 100 stored inside the case body 10 passes a hollow 46 formed on top portion of the screw rod 40 and the inner hole 41 and flows out in a constant amount through a discharging route 32 made in a discharging tube 30. Simultaneously, when the case body 10 stops rotation to decrease internal pressure of the case body 10, the reversing ball 43 can return to its original condition by elastic-repulsion force of a spring 42 mounted in the inner hole 41 on top portion of the screw rod 40 and close the inner hole. As a result, the cosmetics does not discharge out of the case. Briefly, by moving up/down the piston depending on normal/reverse rotational directions of the case body, the reversing ball is under pressure and opens/closes the inner hole, thereby freely controlling discharge and/or interruption of the liquid cosmetics. The present inventive cosmetics case is consisted of:

an upper movable part 20 having groove frame 24 along bottom end circumstance and fitted to top portion of the case body 10 mounted with a body fitting part 12 having top protrusion frame 14;

the discharging tube 30 and the screw rod 40 screw-coupled with the piston 49 installed inside of the case body 10 and the upper movable part 20; and a plug 50 connected at bottom portion of the case body 10.

Such discharging tube 30 forms the discharging route 32 inside and is arranged with a flange 34 outside its bottom end, the flange 34 having D-cut sides 35 at both top sides and an inner fixation side 36 inside.

On top portion of the discharging tube 30, a small hole is punctured to move and discharge the cosmetics 100 out of the case, and fitted with a wetting part 38 such as flocking tip or brush. Top end of the screw rod 40 mounted with the piston 49 is fitted and secured inside bottom end of the discharging tube 30.

The inner hole 41 for inserting the spring 42 and the reversing ball 43 is positioned on top portion of the screw rod 40 and, on both sides around such inner hole 41, a screw rod-fitting part 44 having D-cut side 45 is formed and fitted to bottom end of the discharging tube 30. The liquid cosmetics 100 stored in the case body 10 moves out through the hollow 46 formed bottom portion of said inner hole 41. Alternatively, a supporting part 47 is inserted into and supported by a supporting groove 52 of the plug 50.

Furthermore, an O-ring 48 is fitted on the screw rod-fitting part 44 at top end of the screw rod 40 to ensure air-tight condition when the fitting part 44 is coupled inside the bottom end of the discharging tube 30 to combine with the case body 10.

As described above, the upper movable part 20 constructed of the wetting part 38, the discharging tube 30 and the screw rod 40 is assembled to a cap 60 at top portion thereof. Also, the bottom portion of the case body 10 is connected to the plug 50.

A preferred embodiment according to the present invention is described as follows with reference to the accompanying drawings.

Figure 2:
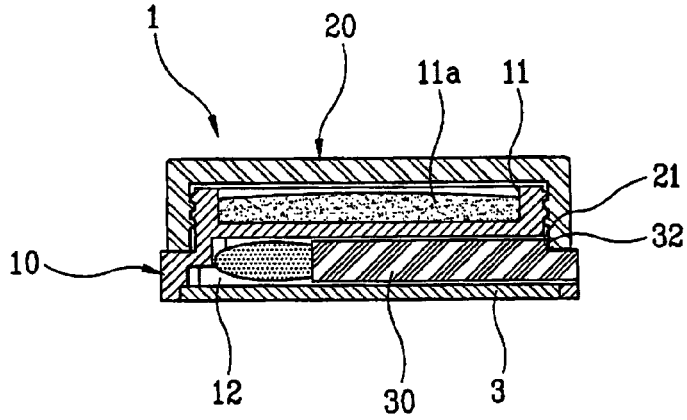
FIG. 2 is an exploded perspective view of the preferred embodiment according to the present invention.
Figure 3:
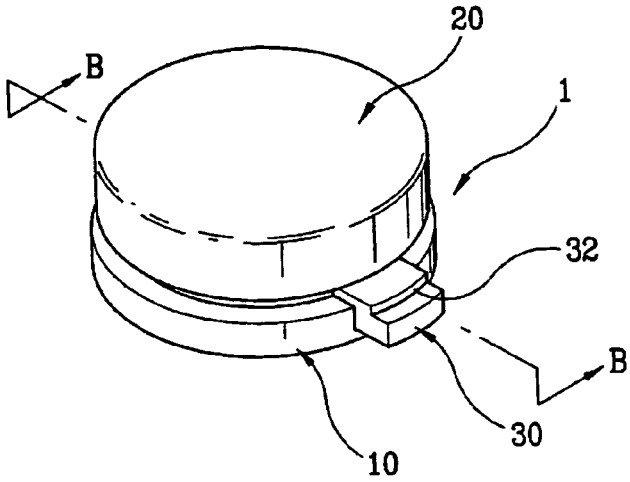
FIG. 3 is a cross-sectional view of the preferred embodiment according to the present invention, showing it in an assembly form.
Figure 4:
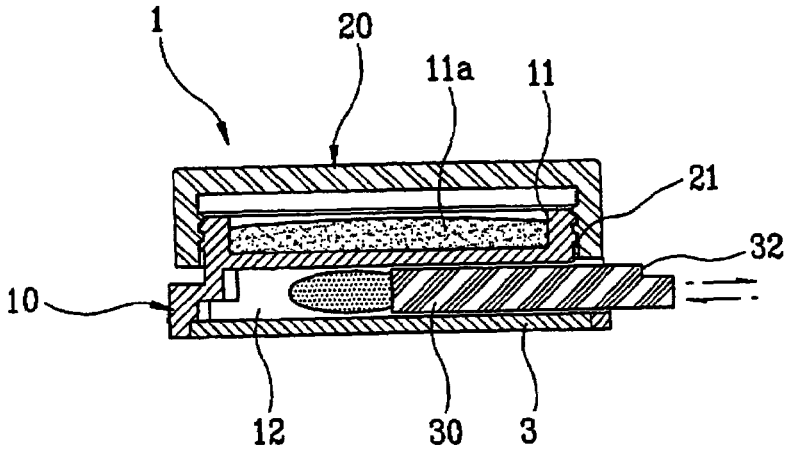
FIG. 4 is another cross-sectional view of the preferred embodiment according to the present invention, showing it practically used.
Figure 5:
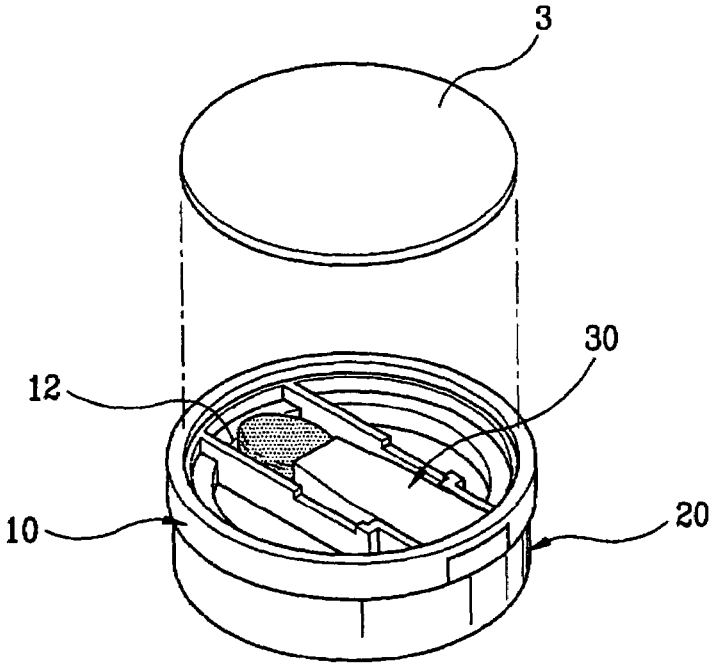
FIG. 5 is an enlarged sectional view of 'A' section of FIG. 4.
Figure 6:
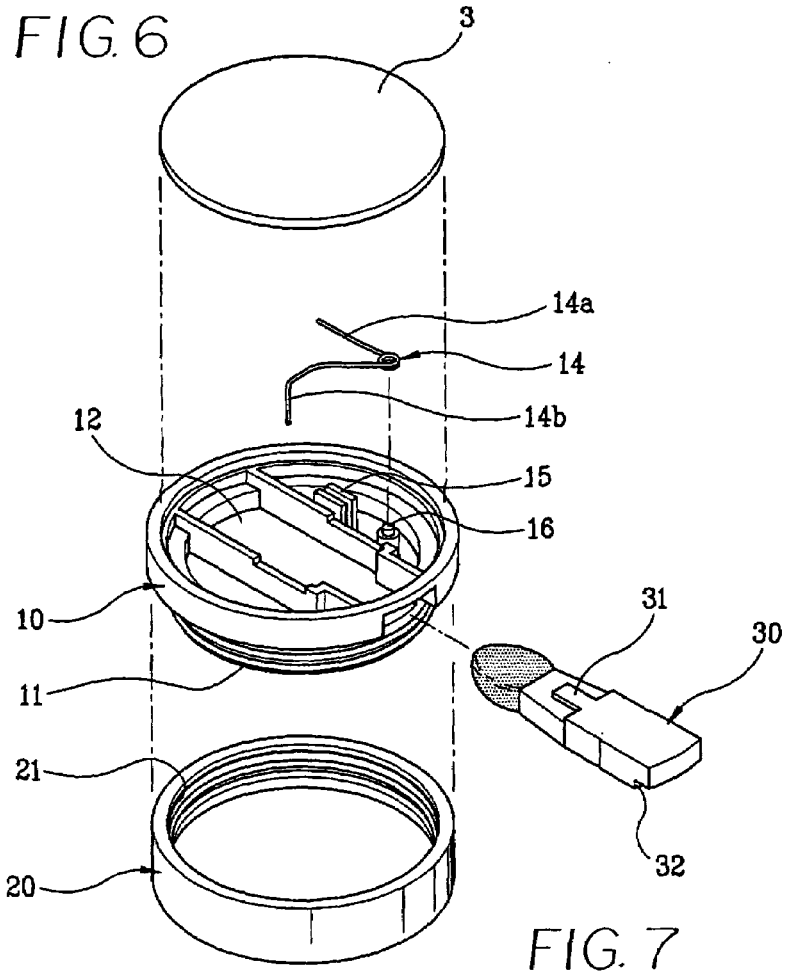
FIG. 6 is a perspective view of a conventional cosmetics case.
Figure 7:
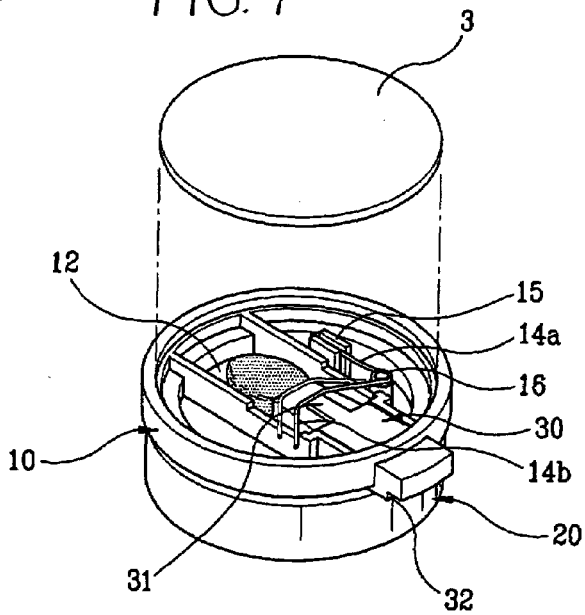
FIG. 7 is an exploded perspective view of the conventional cosmetics case.
Figure 1:
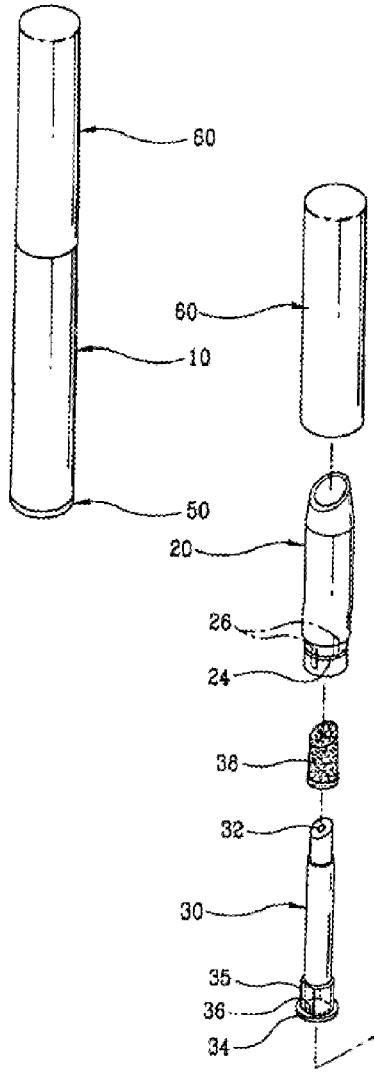
Figure 2:
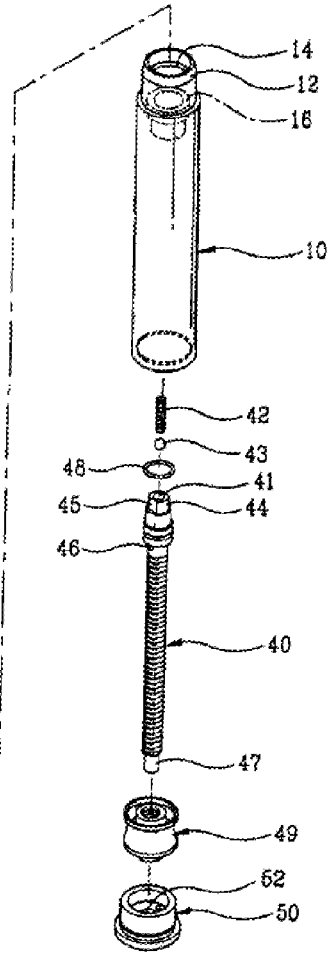
Figure 3:
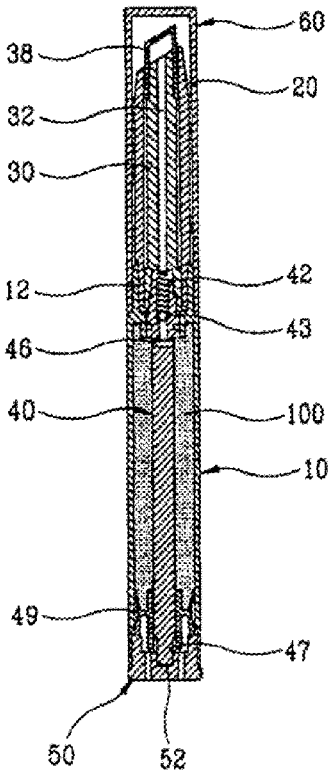
Figure 4:
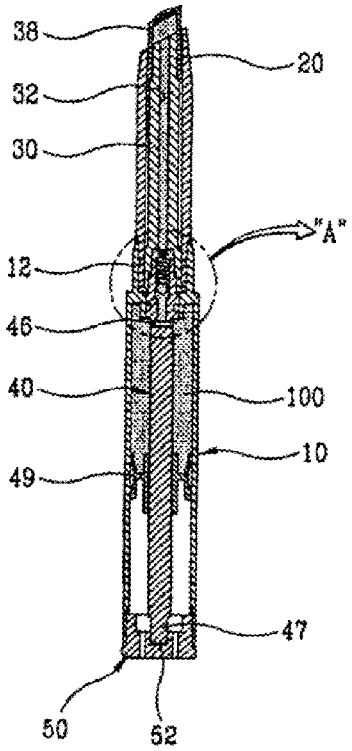
Figure 5:
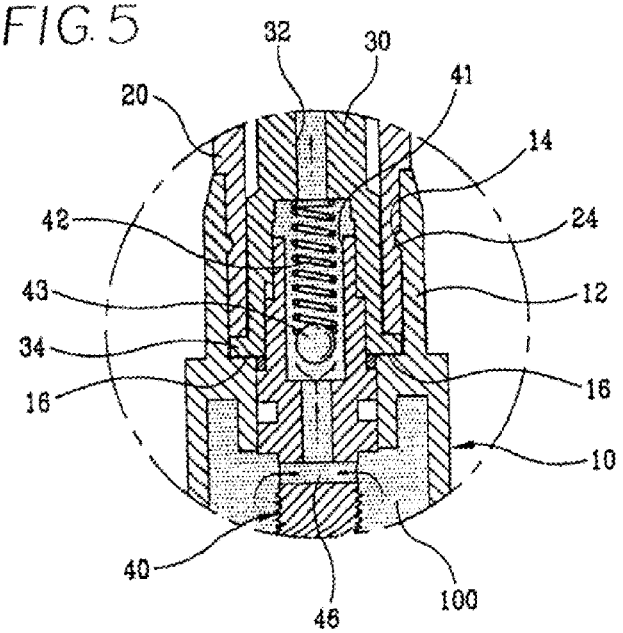
Figure 6:
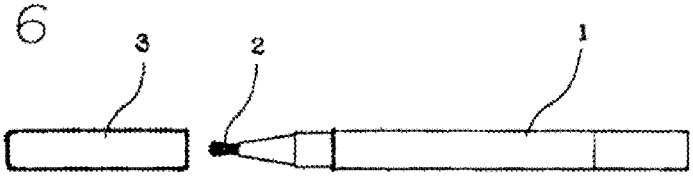
Figure 7:
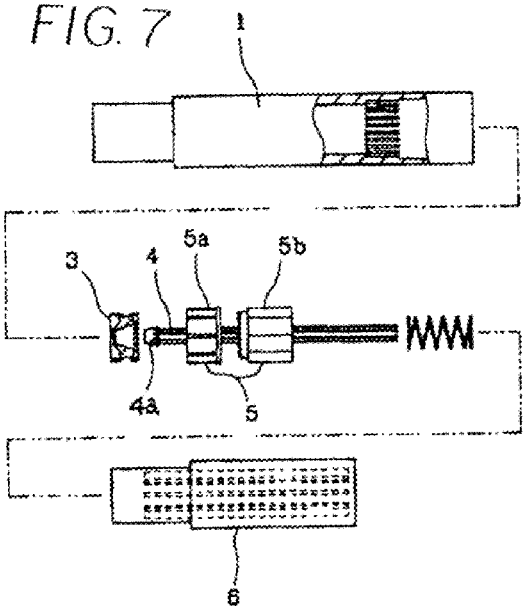

FIG. 1 illustrates a perspective view of the preferred embodiment, FIG. 2 shows an exploded perspective view of the preferred embodiment, FIG. 3 is a cross-sectional view of the preferred embodiment showing it in an assembly form, FIG. 4 illustrates another cross-sectional view of the preferred embodiment showing it practically used, and FIG. 5 shows an enlarged sectional view of 'A' section of FIG. 1.

For example, a process for manufacturing an assembly of the cosmetics case stored with the liquid lipstick will be described as follows:

Firstly, a flocking tip as the wetting part 38 is fitted on top portion of the discharging tube 30.

Such discharging tube 30 is inserted from bottom end of the upper movable part 20 until the wetting part 38 protrudes out of top portion of the upper movable part 20.

Herein, the D-cut side 35 of the discharging tube 30 is fitted on two fixed protrusion sides 26 inside bottom portion of the upper movable part 20 to be at one with them.

Consequently, by forced-fitting the bottom portion of the upper movable part 20 already inserted by and fixed with the discharging tube 30, the groove frame 24 formed around the bottom portion of the upper movable part 20 is securely connected with the top protrusion frame 14.

As stated above, the cosmetics case according to the present invention is completed into an assembly by a process comprising installing the discharging tube 30 in the upper movable part 20 and coupling the upper movable part 20 to the case body 10; putting the screw rod 40 screw-coupled with the piston 49 through inside of the bottom portion of the case body 10; and fitting the screw rod 40 inside bottom ends of the upper movable part 20 and the discharging tube 30 having the flange 34 press-fixed by a threshold 16 formed inside the case body 10, wherein the D-cut side 45 of the screw rod-fitting part 44 formed on top portion of the screw rod 40 is fitted on the inner fixation side 36 formed inside bottom end of the discharging tube 30 and the supporting part 47 at bottom portion of the screw rod 40 is supported into a supporting groove 52 of a plug 50 by plugging the supporting part 47 with the plug 50. Finally, by covering top portion of the upper movable with the cap 60, the cosmetics case of the present invention is completed in an assembly form.

Practical use of the present inventive case assembled as described above will be illustrated as follows:

As shown in FIG. 3, lipstick liquid as the liquid cosmetics 100 is filled in the case body 10 mounted with the screw rod 40 and the piston 49.

In order to discharge and use such liquid cosmetics 100 from the case body 10, an user grips the upper movable part 20 by one hand while rotating the case body 10 in one direction by the other hand to permit the piston 49 to turn together with the case body and to go upward along thread line formed on the screw rod 40.

That is, since said inner wall of piston 49 is screw-coupled to the screw rod 40 while outer circumference part of the piston 49 contacts inner circumference part of the case body 10, the piston 49 closed to the case body 10 moves round at the same time when the case body 10 is rotating and moves upward along the thread line of the screw rod 40.

Such movement of the piston 49 generates pressure inside the case body filled with the liquid cosmetics 100 and, simultaneously, the pressure allows the reversing ball 43 elastically supported by the spring 42 placed in the inner hole 41 on top portion of the screw rod 40 to be pushed upward and to open the inner hole 41. Subsequently, the liquid cosmetics 100 in the case body 10 passes the hollow 46 and flows into the discharging route 32 through the inner hole 41, and is discharged out of the case body 10 through the wetting part 38 fitted on top portion of the discharging tube 30.

Accordingly, depending degree of rotating the case body 10, the liquid cosmetics 100 filled in the case body 10 can discharge to the wetting part 38 and be available for make-up use. (See FIG. 4) As described above, by rotating the case body 10 to a desirable range for discharging the liquid cosmetics 100, a constant amount of pressure is applied to inside of the case body 10 to discharge the liquid cosmetics 100 outside; in addition to, when the internal pressure of the case body 10 is reduced, the reversing ball 43 returns to its original condition by elastic-repulsion force of the spring 42 placed in the inner hole 41 on top end of the screw rod 40 and closes the inner hole 41, thereby allowing discharge of the liquid cosmetics to be interrupted.

Consequently, the liquid cosmetics case according to the present invention effectively discharges the liquid cosmetics 100 only by rotating the case body 10 while interrupts the discharge of the cosmetics 100 during a stop position.

Meanwhile, if the user excessively turns round the case body 10 for discharging the liquid cosmetics 100 to result in excessive discharge thereof, it can be interrupted by rotating the case body 10 to the opposite direction to make the piston 49 screw-coupled to the screw rod 40 turning back and inner space of the case body 10 to be in a vacuum state and, as a result, to pull up the reversing ball 43 in the inner hole 41 and to close the inner hole 41 thereby interrupting excessive discharge of the liquid cosmetics 100.

In conclusion, it will be understood that the present invention can discharge the liquid cosmetics 100 in desired amount and interrupt the discharge thereof as it needs, and prohibit leak of the cosmetics 100 by functional feature of the reversing ball 43 even when the temperature is changed or the internal pressure of the case body 10 increases and/or varies.

INDUSTRIAL APPLICABILITY

As clearly described above, the cosmetics case for liquid cosmetics according to the present invention which comprises a case body, a screw rod placed in the case body, an inner hole on top end of the screw rod, a spring and a reversing ball; the reversing ball capable of opening/closing the inner hole, so that the case can freely control discharge and/or interruption such discharge of the liquid cosmetics; and prohibit natural leak of the liquid cosmetics during non-use of the case by applying elastic force of the spring to make the reversing ball to close the inner hole even when the temperature is changed or the internal pressure of the case body increases and/or varies. Accordingly, the present inventive cosmetics case can achieve improvement and convenience of using and storing liquid cosmetic products.

What is claimed is:

1. A cosmetics case for storing liquid cosmetics, comprising:

an upper movable part and a case body, the upper movable part coupled to a cap at top portion thereof while the case body is provided with a plug at a bottom portion of the case body, wherein the case has a discharging tube covered with a wetting part and a piston screw-coupled to a screw rod, both being secured to the upper movable part and inside of the case body; an inner hole formed on top end of the screw rod and fitted with a spring and a reversing ball; and a hollow on bottom portion of the inner hole so that the liquid cosmetics in the case body flows to the wetting part through the discharging tube; and wherein the discharging tube has a bottom end and further comprising a flange arranged outside the bottom end of the discharging tube, the flange having D-cut sides.

2. The cosmetics case of claim 1, wherein the flange has an inner fixation side.

* * * * *

UNITED STATES PATENT AND TRADEMARK OFFICE

CERTIFICATE OF CORRECTION

PATENT NO. : 7,093,739 B2
APPLICATION NO. : 10/671507
DATED : August 22, 2006
INVENTOR(S) : Young Kwang Byun It is certified that error appears in the above-identified patent and that said Letters Patent is hereby corrected as shown below:

The title page should be deleted and substitute therefor as shown on the attached title page.

Drawings:

Delete figures 1-7 and substitute therefor figures 1-7 as shown on the attached pages.

Signed and Sealed this

Thirtieth Day of September, 2008

JON W. DUDAS
*Director of the United States Patent and Trademark Office*

(12) United States Patent
Byun

(10) Patent No.: US 7,093,739 B2
(45) Date of Patent: Aug. 22, 2006

(54) COSMETICS CASE FOR LIQUID COSMETICS

(76) Inventor: Young-Kwang Byun, 928-1005, Mok-Dong APT, 312 Shinjeong-Dong, Yangcheon-Ku, Seoul 158-769 (KR)

( * ) Notice: Subject to any disclaimer, the term of this patent is extended or adjusted under 35 U.S.C. 154(b) by 0 days.

(21) Appl. No.: 10/671,587

(22) Filed: Sep. 29, 2003

(65) Prior Publication Data

US 2004/0256416 A1 Dec. 23, 2004

(30) Foreign Application Priority Data

Jun. 20, 2003 (KR) ..... 10-2003-0040049

(51) Int. Cl.
*B67D 5/42* (2006.01)

(52) U.S. Cl. ..... 222/390; 401/172; 401/175; 132/290

(58) Field of Classification Search ..... 401/172, 401/174, 175; 222/390, 325–327; 132/290
See application file for complete search history.

(56) References Cited

U.S. PATENT DOCUMENTS 1,591,678 A * 7/1926 Garris ..... 222/320
1,943,893 A * 1/1934 Johnson ..... 401/175
1,968,686 A * 7/1934 Janer ..... 222/390
2,699,880 A * 1/1955 Johnson ..... 222/390
3,100,315 A * 8/1963 Lasalt ..... 401/175
3,802,023 A * 4/1974 Spatz ..... 15/192
3,807,881 A * 4/1974 Seidler ..... 401/175
4,655,627 A * 4/1987 Bradley ..... 401/171
4,957,125 A * 9/1990 Yamera ..... 132/309
5,851,079 A * 12/1998 Horstman et al. ..... 401/174

* cited by examiner

*Primary Examiner*—Frederick Nicolas
(74) *Attorney, Agent, or Firm*—Birch, Stewart, Kolasch & Birch, LLP

(57) ABSTRACT

The present invention relates to a cosmetics case for storing cosmetics such as liquid lipstick and/or foundation and forced discharging the cosmetics as it needs, more particularly, a cosmetics case comprising an upper movable part and a case body, the upper movable part coupled to a cap at top portion thereof while the case body mounted with a plug at bottom portion of the case body, wherein the case has a piston screw-coupled to a screw rod inside the case body and a spring and a reversing ball mounted inside an inner hole formed on top end of the screw rod so that, depending on the case body rotating in normal/reverse directions, the piston goes up and comes down and presses on the reversing ball to make the inner hole to be opened/closed, thereby free controlling discharge and isolation of liquid cosmetics.

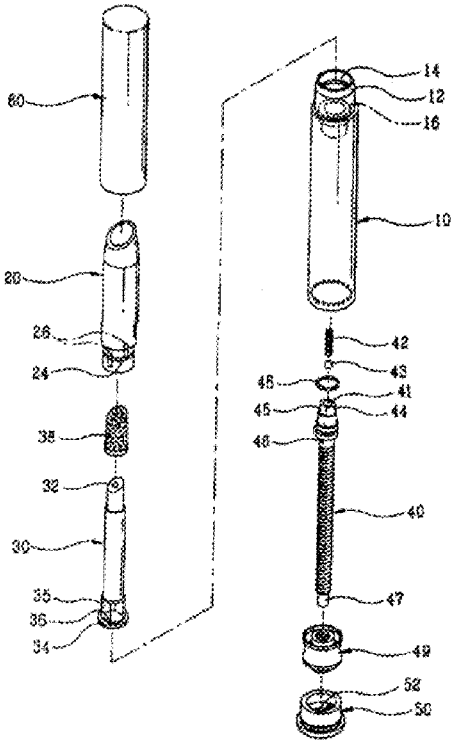

2 Claims, 3 Drawing Sheets